US006968801B2

(12) United States Patent
Baker

(10) Patent No.: US 6,968,801 B2
(45) Date of Patent: Nov. 29, 2005

(54) PORTABLE AND STOWABLE SAFETY DEVICE

(76) Inventor: Stephen J. Baker, 4100 Harbor Rd., Orange Beach, AL (US) 36561

( * ) Notice: Subject to any disclaimer, the term of this patent is extended or adjusted under 35 U.S.C. 154(b) by 0 days.

(21) Appl. No.: 10/945,309

(22) Filed: Sep. 20, 2004

(65) Prior Publication Data

US 2005/0076821 A1 Apr. 14, 2005

Related U.S. Application Data

(63) Continuation-in-part of application No. 10/684,848, filed on Oct. 14, 2003, now Pat. No. 6,792,887.

(51) Int. Cl.[7] ..... B63B 17/00
(52) U.S. Cl. ..... 114/362; 182/196
(58) Field of Search ..... 114/362; 182/196

(56) References Cited

U.S. PATENT DOCUMENTS

| | | | |
|---|---|---|---|
| 2,651,789 | A | 9/1953 | Newland |
| 2,975,858 | A | 3/1961 | Billingsley |
| 4,926,965 | A | 5/1990 | Fox |
| 4,986,785 | A | 1/1991 | Flowers |
| 5,074,236 | A | 12/1991 | Robertson |
| 5,542,369 | A | 8/1996 | Ingram |
| 5,704,447 | A | 1/1998 | Doyle |
| 5,848,667 | A | 12/1998 | Davidson |
| 6,343,562 | B1 | 2/2002 | Ingram |
| 6,464,038 | B1 | 10/2002 | Park |
| 6,533,626 | B2 | 3/2003 | Pons |
| 2002/0119715 | A1 | 8/2002 | Pons |

*Primary Examiner*—Jesus D. Sotelo
(74) *Attorney, Agent, or Firm*—Bradley Arant Rose & White LLP

(57) ABSTRACT

A safety device including a support that may be stowed within an enclosure and easily extended for use. One embodiment comprises a support that may act as a handle and a step, a strap, the lower end of which is attached to the support, and a keeper comprising a pouch closable by a flap to form an enclosure. The upper end of the strap is attached to the interior of the keeper, and the keeper may be attached to a vessel or other object via a loop on its rear side. The strap is gathered inside the keeper, with the handle hanging outside the keeper and fixed in position by the closed flap, such that the handle when pulled will cause the flap to open and the strap to extend.

19 Claims, 6 Drawing Sheets

PORTABLE AND STOWABLE SAFETY DEVICE

This application is a Continuation-in-Part of application Ser. No. 10/684,848, now U.S. Pat. No. 6,792,887.

BACKGROUND

The present invention provides a lightweight, stowable and extendable step, or steps, to allow easy entry into a vessel by a person in the water, and for a variety of other uses. The invention is discussed and illustrated with respect to kayaks, but it may be used with virtually any water-borne vessel to which it may be secured.

Persons involved in sea kayaking, canoeing, sailing, or other boating activities may fall into the water, either intentionally or unintentionally. Depending on the conditions, such as current, wave level, water temperature, weather, and the like, it may be difficult to re-enter the vessel, and for some people with physical restrains or handicaps, or wearing heavy clothing or shoes, re-entry under any conditions may be difficult. Difficulty in re-entering a vessel from the water poses a safety issue and discourages some people from participating in these activities altogether.

A simple device to allow re-entry of a vessel from the water is needed. The device should satisfy various requirements of the marine environment and of the particular application in which it is used. For example, it must be durable and capable of withstanding water and sun. It should be stowable and secure, so that it does not interfere with other activities or objects on the vessel, such as paddling or lines and ropes on and extending from the vessel (e.g., ski ropes, anchor lines, fishing lines, etc.). It ought to be adjustable in length and attach to a variety of vessels, and it would also be advantageous if the device were lightweight, relatively inexpensive, and easy to use. In addition, it would be advantageous for the device to accommodate multiple straps and handles. Such a configuration would allow a handicapped person, for example, to adjust the different straps to desired lengths and position the handles to satisfy specific needs. It also would be helpful if the device were capable of attachment to personal flotation devices or any other sort of safety harness.

The embodiments of the present invention, as described and claimed herein, satisfy these needs and provide a stowable and extendable step that may be attached to virtually any vessel and which allows easy re-entry from the water into the vessel, as well as attachment to personal flotation devices, and may be used for a variety of other uses. The device thus increases safety and encourages participation in and the enjoyment of boating activities.

SUMMARY

[rewrite]

DESCRIPTION OF DRAWINGS

These and other features, aspects, structures, advantages, and functions are shown or inherent in, and will become better understood with regard to, the following description and accompanied drawings where.

DETAILED DESCRIPTION

Figure 1:
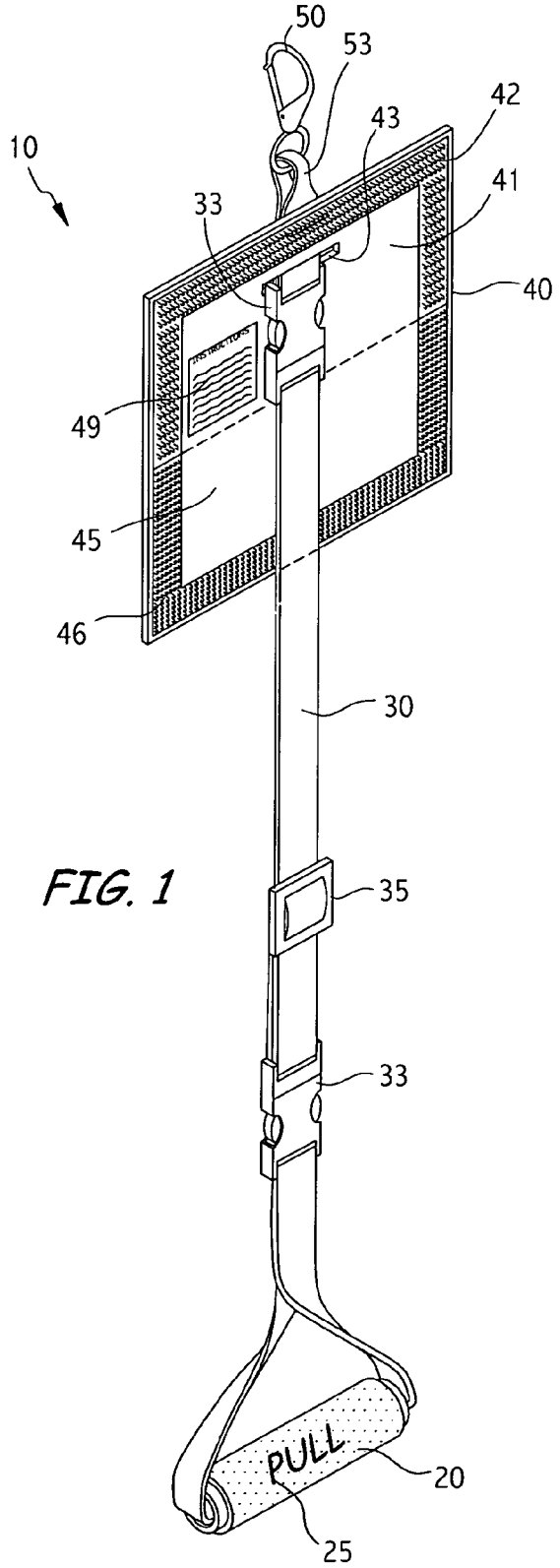
FIG. 1 is a perspective view of one embodiment of the present invention, with the strap extended and the keeper in an open configuration.

As shown in FIG. 1, one embodiment of a stowable and extendable step 10 comprises a support 20 (which may act both as a handle and a step and is generally referred to herein as the step), a strap 30, the lower end of which is attached to the step 20, and a piece of foldable material 40 which acts as a keeper for the strap 30. The upper end of the strap 30 is attached to the vessel, directly or indirectly.

The keeper 40 comprises a slot 43, through which the strap 30 passes. The keeper 40 also comprises complementary releasable fasteners 42 and 46, such as Velcro, placed along at least a portion of its perimeter. The keeper 40 may be viewed as having an upper area 41 and a lower area 45, with the fasteners 42 on the upper area being complementary or interlocking with the fasteners 46 on the lower area 45. In this way, the keeper 40 serves as an enclosure when the lower area 45 is folded up and into contact with the upper area 41, such that the interlocking fasteners 42 and 46 engage and secure the keeper in the enclosed configuration shown in FIG. 2.

Figure 2:
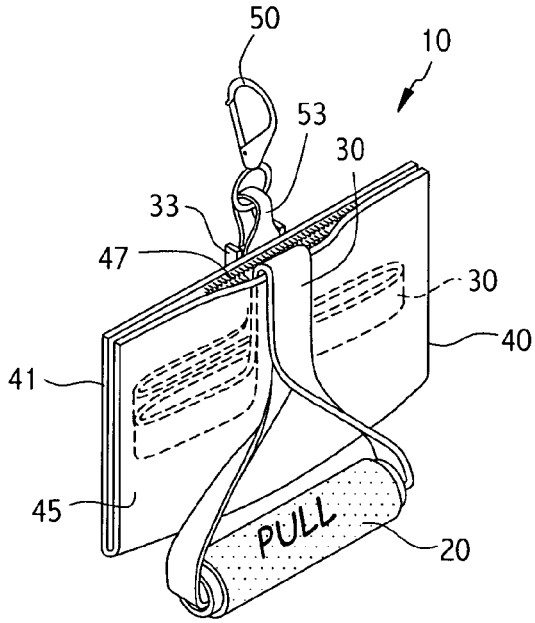
FIG. 2 is the embodiment of FIG. 1 with the strap and the keeper in a closed, stowed configuration.

In use, the strap 30 is coiled or gathered and held adjacent to keeper 40, in its open configuration, and then the keeper 40 is folded as described above to form an enclosure holding the strap 30 in a retracted configuration inside, as shown in FIG. 2. The end of strap 30 attached to the step 20 extends through the upper junction 47 of the now-interlocked upper and lower areas of the keeper 40, such that the step 20 hangs just on the outside of the keeper. When the step 20 is pulled, the strap 30 extends and the keeper 40 opens.

The other end of the strap 30 is attached to the vessel either directly or indirectly. The end of the strap may extend through the slot 43 and be secured to the vessel via the clasp 50, which may be secured to rigging, an eyelet, a cleat, a tie-down or other securing means on a vessel. The strap 30 may be attached to the vessel via a loop 53 (as shown) or similar device attached to keeper 40, which also is attached to clasp 50, which may be secured to the vessel.

Figure 5:
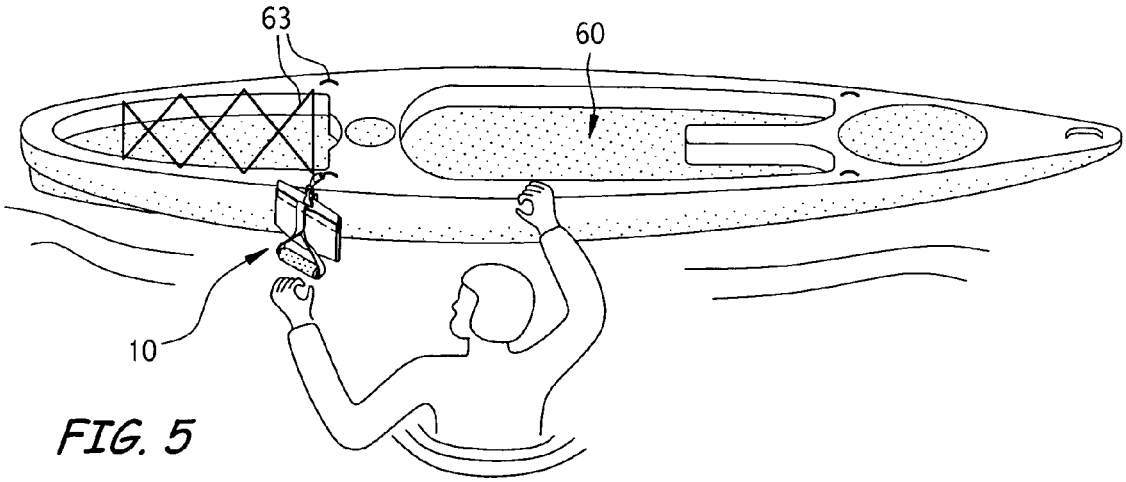
FIG. 5 is a perspective view of an embodiment of the present invention, in its closed, retracted configuration, attached to a kayak, with a kayaker in position to grab the step.
Figure 6:
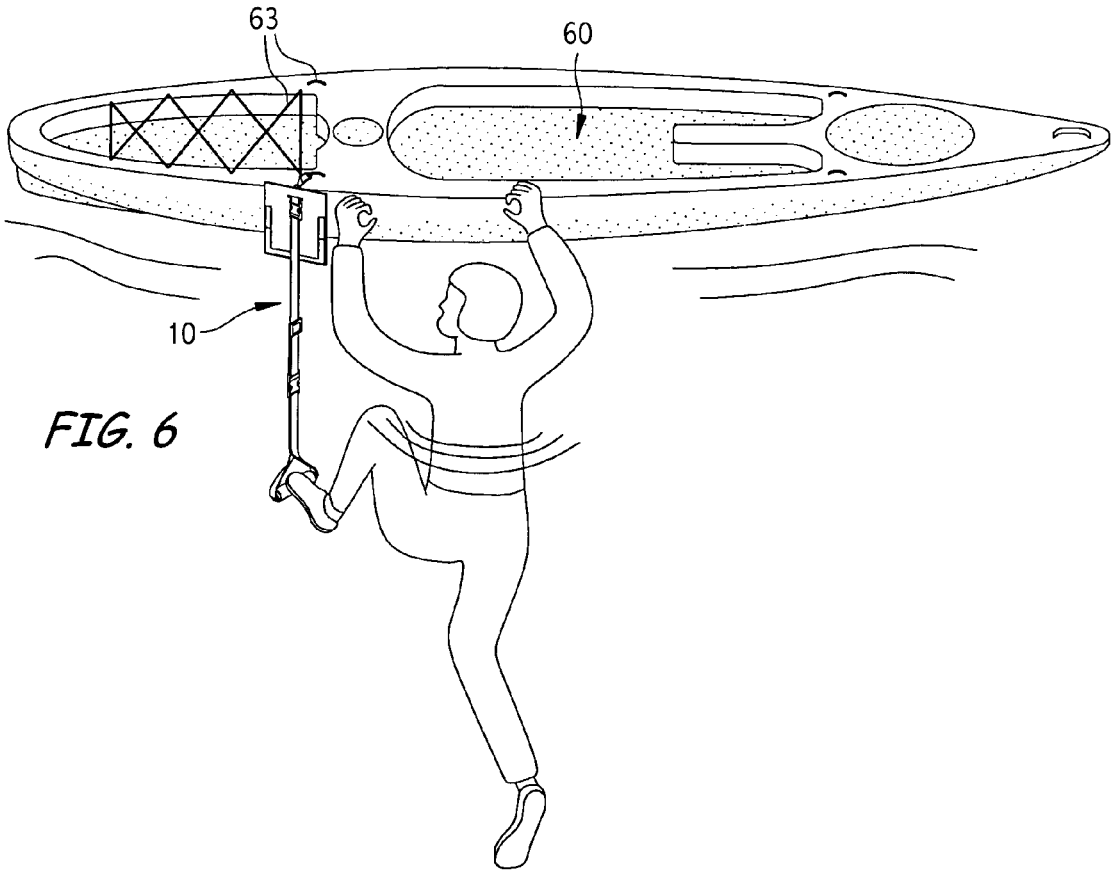
FIG. 6 is a perspective view of embodiment shown in FIG. 5, in its open, extended configuration, with the kayaker having put his foot in place on the step and preparing to board the vessel.

The device is shown in use in FIGS. 5–6. FIG. 5 illustrates the stowable and extendable step 10, in a closed configuration, attached to a vessel (shown as a sea kayak) with a user in the water in position to use the step to re-enter the vessel. The user grasps and pulls on the step 20, causing the strap 30 to extend. Then as shown in FIG. 6, the user guides the step 20 to his foot, grabs onto the vessel, steps against the step 20 and is in position and able to lift himself into the boat. As the person bears his weight on and pushes against the step, the vessel rolls laterally towards the person and thus allows the user to easily enter the vessel.

As noted, the step 20 acts as both a handle and step. It may be constructed of any suitable material that will allow a user to grasp it and also support the user as he re-enters the boat. The step 20 may even simply be a loop in the end of the strap 30. As shown, the step 20 is a rigid, tubular step through which the strap 30 passes. The step may have a foam or polymer grip to improve ergonomics and reduce slippage in the water. Further, the step 20 may be constructed such that it floats. In that way, if a user were to let go of the step 20 after pulling it out of the keeper 40, the user may easily locate the step floating on the surface of the water. The step 20 may have the word "PULL" or other text written on it. The step and the word may be of any desirable color, and it has been found that a bright red or orange step, with contrasting and reflective print or highlights, is helpful in easily seeing and locating the step either on the vessel or in the water.

The strap 30 may be constructed of any suitably strong and durable material, capable of maintaining its strength and longevity in a wet environment. Commonly available nylon webbing is adequate. The strap 30 may include quick-release buckles 33 as a safety measure in case the need arises to quickly separate the step or strap from the vessel. Quick-release buckles 33 may be placed anywhere along the strap, and in particular it has been found helpful to place one near the upper end so that it is positioned just below the slot 43 when the keeper is open, or at the lower end closer to the step 20, or in both positions. In this way, a quick-release buckle 33 is visible and accessible whether the keeper is in an open or closed configuration, and whether the strap 30 is stowed or extended. In addition to safety concerns, the buckles 33 allow the easy replacement of the strap, the handle, or both. The strap 30 may also include an adjustment clip 35 so that the length of the strap may be customized to a particular user or vessel. As with the step 20, the strap 30 may be of any desirable color and include reflective highlights to facilitate its visibility.

The keeper 40 may be constructed of any suitably strong and durable material, capable of folding and unfolding easily without weakening, and of maintaining its strength and longevity in a wet environment. The keeper 40 is illustrated as a single substantially planar piece of material, in a rectangular form. Durable nylon fabric or heavy-duty vinyl is suitable. It could be constructed of a mesh material. The keeper may be of any suitable shape, polygonal, circular, or irregular, depending on the needs and preferences of a user or a particular application. Like the other components of the device, the keeper may be of any desirable color and may include reflective highlights. Further, the keeper may be constructed to comprise some amount of hydrophobic foam or low density material such that it floats. Depending on the intended environment or use, for example in an industrial or commercial application, the keeper could be constructed from two pieces of metal (e.g., stainless steel or aluminum), with a sprung hinge to allow opening and closing and release of the strap.

Instructions 49 may be printed, sewn to, or otherwise attached on the keeper 40, as show in FIG. 1. The interlocking fasteners 42 and 46 are shown in FIG. 1 to be a hook-and-loop type fastener (Velcro). Other interlocking fasteners, such as snaps, buttons, and the like, could be used, though these are not as durable or easy to use as Velcro. Similarly, the fasteners need not be disposed along the entire perimeter of the keeper 40.

Figure 3:
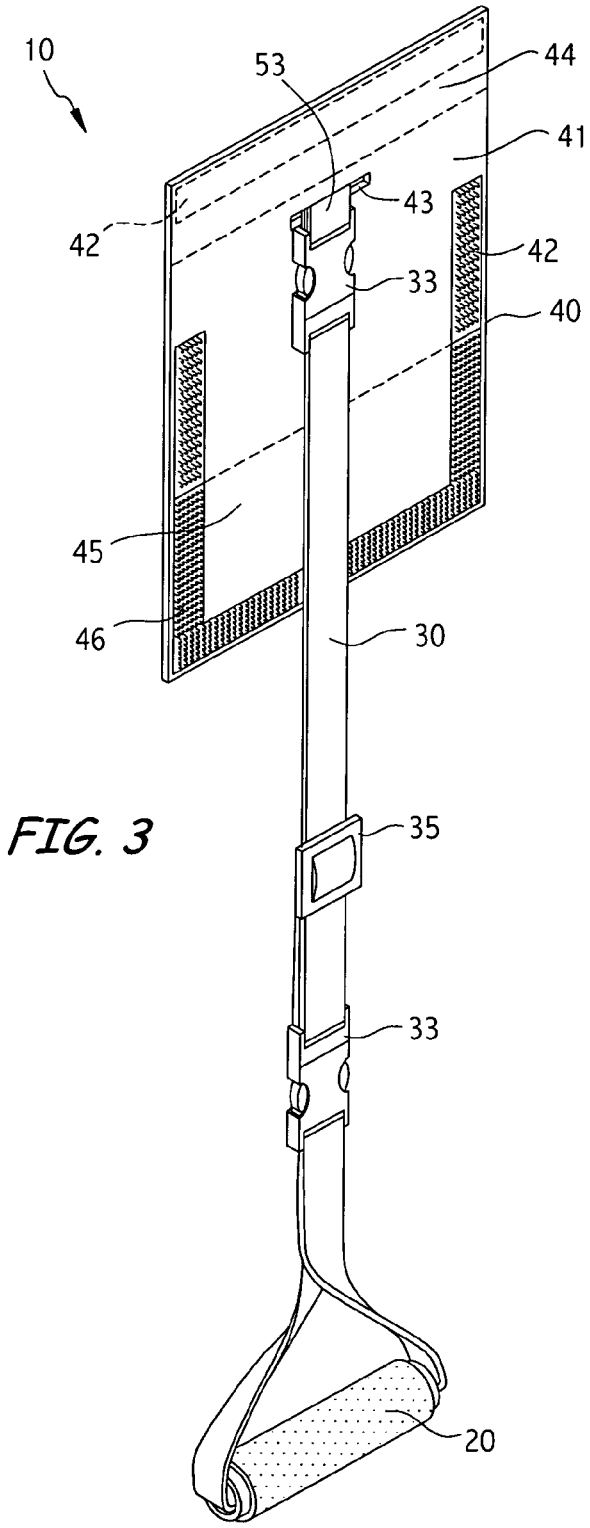
FIG. 3 is a perspective view of a second embodiment of the present invention, with the strap extended and the keeper in an open configuration.
Figure 4:
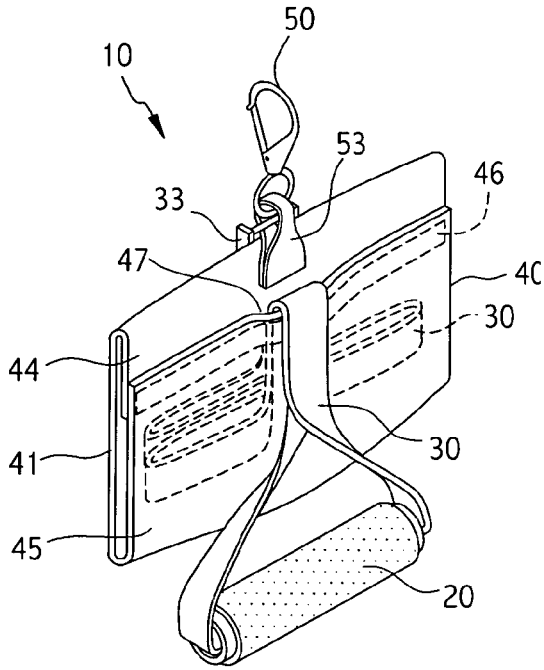
FIG. 4 is the embodiment of FIG. 3 with the strap and the keeper in a closed, stowed configuration.

Another embodiment of the present invention is illustrated in FIGS. 3–4. As shown in FIG. 3, the upper area 41 of the keeper 40 includes a top section 44, which has releasable fasteners 42 on its back side. Top section 44 is folded down, and then lower area 45 is folded up and into contact with the top section 44, such that the interlocking fasteners 42 and 46 engage and secure the keeper in the enclosed configuration shown in FIG. 4. The other features and aspects of the first embodiment, described above, may be applied to the embodiment shown in FIGS. 3–4.

In either embodiment, the keeper 40 could be constructed without a slot 43, and the strap 30 could be sewn or otherwise attached directly to keeper 40. Attachment of the upper end of the strap 30 to the lower area 45 of the keeper 40 would facilitate the opening of the keeper 40 when the strap was pulled by a user. In this variation, the keeper 40 is attached (via a loop 53 and clasp 50 or similar means) to the vessel.

Figure 7:
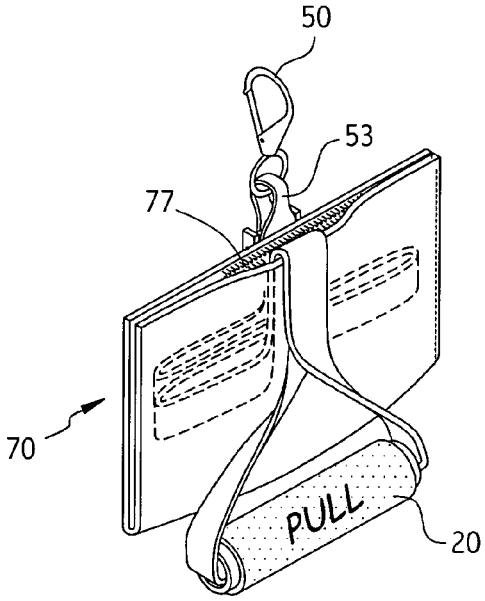
FIG. 7 is a perspective view of another embodiment of the present invention, in a stowed configuration.
Figure 8:
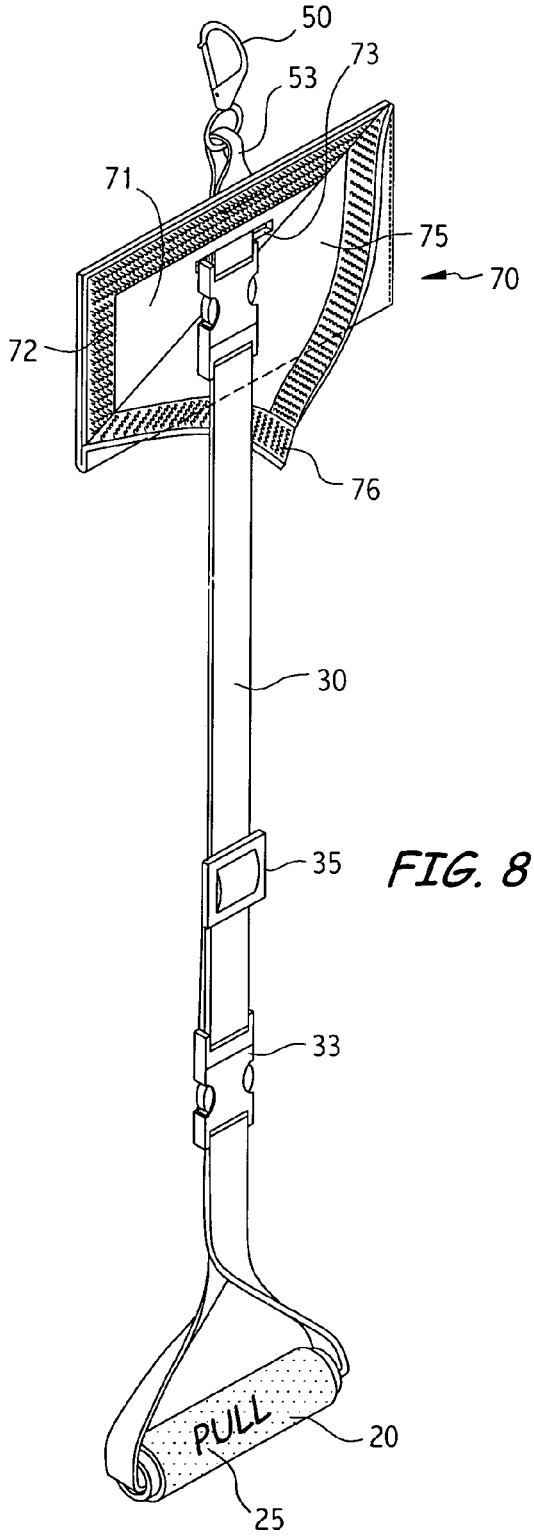
FIG. 8 is a perspective view of the embodiment of FIG. 7, in an open and extended configuration.

FIGS. 7–8 shows an alternate embodiment of the invention, in which a keeper 70 comprises two layers 71 and 75 of approximately the same dimensions affixed together along the lower and one side perimeter, and with interlocking fasteners 72 and 76 on facing surfaces of the upper and other side perimeter. The closure of the lower perimeter could be effected by a folding a single piece of material, similar to the manner described above, with the perimeters of one side of each resulting layer stitched. Alternatively, two separate pieces of material could be used. It should be noted that the keeper could be of any desired shape, as long as the inner and outer layers could be brought together to form an enclosure. As with the embodiments described above, a strap 30, optionally including an adjustment clip 35 and releasable buckles 33, terminating in a support (or step) 20 is provided. The upper end of the strap extends through a slot 73 and terminates in a loop 53 and clasp 50. Other attachment means could be used, such as the strap itself being turned back and secured on itself (via stitching or using a clip 35) forming a closed loop, terminating in a metal ring or in one component of a two-component releasable buckle 33. Likewise, the slot could be eliminated and the upper end of the strap secured directly or indirectly to the keeper, with the keeper including a loop or other attachment means on its back side for attachment to a vessel, person, or other object. The strap 30 is gathered and stowed within the enclosure formed by interlocking the inner layer 71 to the outer layer 75, with the lower end of the strap 30 extending through a gap in the junction 77 of the layers, such that the step 20 hangs just on the outside of the keeper. When the step 20 is pulled, the strap 30 extends and the keeper 70 opens.

Figure 9:
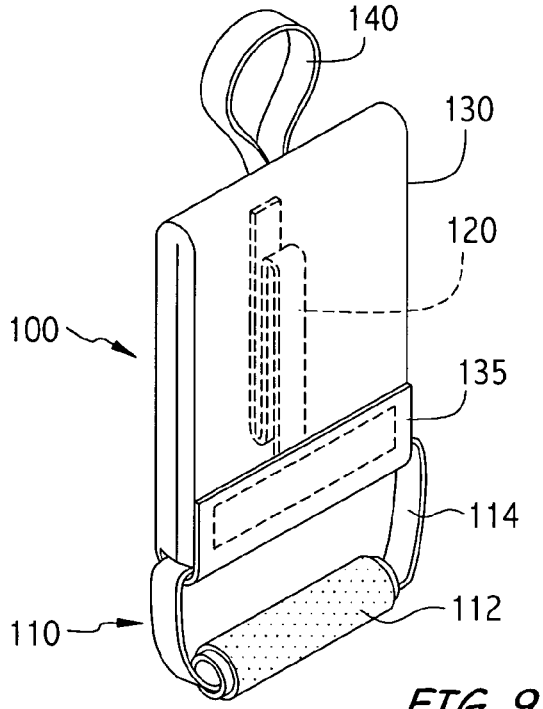
FIG. 9 is a perspective view of yet another embodiment of the present invention, in a stowed configuration.
Figure 11:
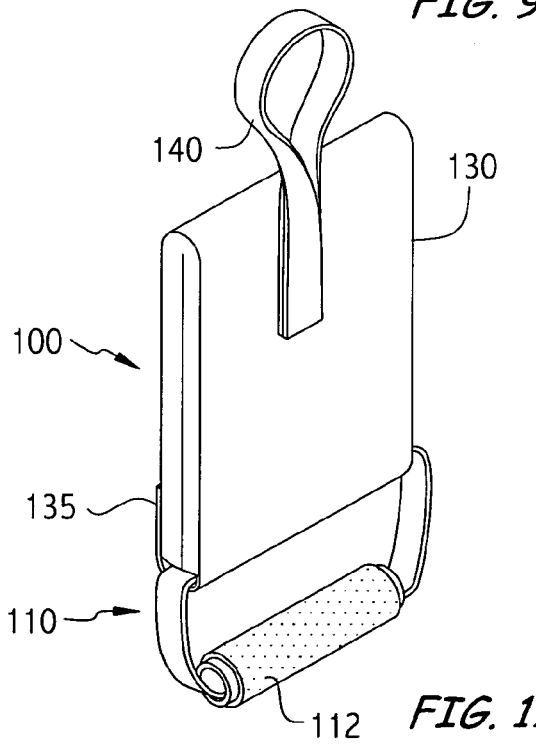
FIG. 11 is a perspective view of the back side of the embodiment of FIG. 9.
Figure 10:
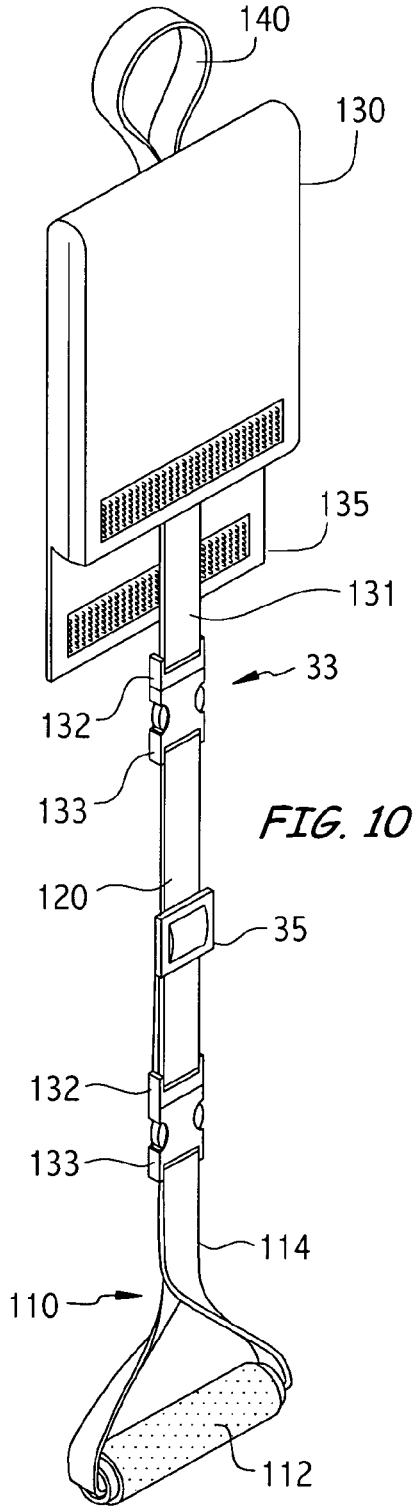
FIG. 10 is a perspective view of the embodiment of FIG. 9, with the strap in an extended configuration.

FIGS. 9–11 show another embodiment of the invention, safety device 100, comprising a support 110, a primary strap 120, and a pouch-like keeper 130. The keeper 130 comprises a flap 135 and a loop 140 affixed to the rear of the keeper. The device 100 also includes multiple releasable buckles 33. The releasable buckles 33 comprise two complementary components 132 and 133 which interlock together when joined. The primary strap 120 includes adjustment clip 35. The upper end of the primary strap 120 is defined by one component of a releasable buckle 33, with a short strap 131 attached to keeper terminating in the complementary component of the releasable buckle, such that the primary strap 120 and short strap 131 may be secured together. The support 110 may comprises a gripping surface such as a tubular handle 112 with a looped support strap 114 threaded through the tubular handle 112 and terminating in one component of a releasable buckle 33, with the lower end of the primary strap 120 terminating in the complementary portion of the buckle 33, such that the primary strap 120 and the support strap 114 may be secured together.

The loop 140 on the back of the keeper allows the keeper to be attached quickly and easily to a variety of objects, such as a cleat on a vessel, a strap or loop on a personal flotation device, a safety harness or virtually any object to which the user desires the safety device to be attached. The flap 135 of the keeper may be opened or secured to the main body of the keeper with releasable fasteners, such as Velcro®. In operation, the strap 120 is gathered within the keeper 130 with the handle 112 and part of the support strap 114 extending outside. The flap 135 is brought through the loop formed by support strap 114 and closed with the lower releasable buckle 33 within the keeper. The closure of the flap 135 in this way thus fixes the handle 112 in position hanging outside the keeper. When a user pulls on the handle 112, the flap 135 opens and the strap 120 extends.

Figure 12:
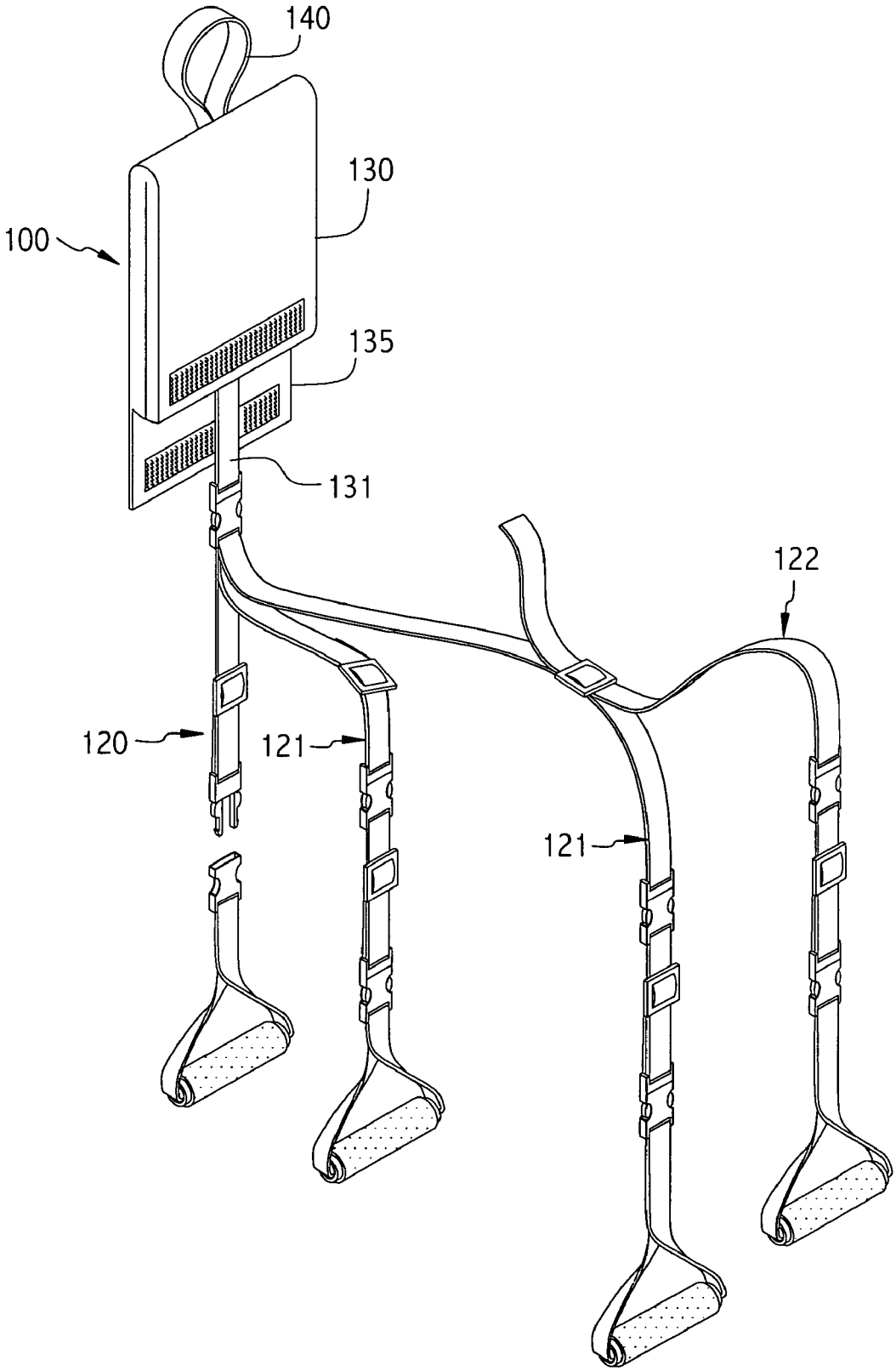
FIG. 12 is a perspective view of the embodiment of FIG. 9 in which multiple straps and supports are utilized.

FIG. 12 shows the embodiment of FIG. 9 in which multiple straps and handles are utilized. In particular one or more secondary straps 121 may be secured to the primary strap 120, and likewise one or more tertiary straps 122 could be secured to a secondary strap 121, and so on. The straps may secured together in any manner known in the art. For example, they could be permanently stitched together, or the secondary strap could be threaded and doubled back through an adjustment clip 35, or threaded through the same buckle component as attached to the primary strap. Each secondary or tertiary strap may include its own releasable buckles and adjustment clips, with supports and handles of desired size or utility attached. Indeed, any article that could be connected to the complementary component of a releasable buckle could be secured to the lower end of a secondary or tertiary strap. The lower end could terminate in any other type of attachment member desired, such as a closed loop, a clasp, a ring, and one component of a two-component releasable buckle.

This modular configuration allows a large array of uses for the device. One example would be to adjust the length of the tertiary, secondary, and primary straps, such that each strap is longer than the next, thus forming a ladder of steps. Or, two straps could be utilized and adjusted to allow the user to tow a kayak (to which the device 100 is secured). The handicapped have special needs and the various straps and supports (or other devices attached to the straps) may be customized to suit those needs.

The portable, stowable safety device thus described and illustrated provides an easy-to-use, readily accessible way for almost any person to enter a vessel, such as a kayak, from the water. In addition, an overboard person can simply hold onto the step to prevent being separated from the vessel. The device may be secured to a personal flotation device to allow a rescuer to have a ready and easy hand-hold on a person in the water. This device thus makes boating safer and more enjoyable for individuals, especially those with disabilities, who would otherwise be unable to regain entry into the vessel from the water. Further, the device is lightweight and portable, and thus may easily be moved from one vessel to another, or from one personal flotation device to another. It may be used on virtually any type of watercraft, including kayaks, ocean kayaks, canoes, ski boats, fishing boats, sailboats, party or pontoon boats, life boats, white-water rafts and other rafts, and any other vessel or object to which the safety device may be secured.

The uses of the device as claimed should not be restricted to water or marine-based uses. For example, the device could be configured for use as a stowable fire escape ladder for residential use, or as a ladder for hunters to use in accessing deer stands.

Although the present invention has been described and shown in considerable detail with reference to certain preferred embodiments thereof, other embodiments are possible. The foregoing description is therefore considered in all respects to be illustrative and not restrictive. Therefore, the present invention should be defined with reference to the claims and their equivalents, and the spirit and scope of the claims should not be limited to the description of the preferred embodiments contained herein.

I claim:

1. A safety device comprising:

a first and a second releasable buckle, each said buckle comprising two components complementary to one another to interlock releasably together;

a primary strap adjustable in length having one component of said first buckle defining an upper end of said primary strap and one component of said second buckle defining a lower end of said primary strap;

a support comprising a gripping surface secured by a support strap to the complementary component of the second releasable buckle, such that the lower end of said primary strap may be releasably buckled to said support; and a keeper comprising:

a pouch with an interior surface and an exterior surface, said pouch having at its lower end an opening and a flap foldable over said opening and releasably securable to the exterior surface of said pouch opposite from the flap; and a loop fixed to the back side of said pouch for securing said device to a person or object; and wherein the complementary component of said first releasable buckle is secured to the interior of said pouch and is accessible when said flap is open, such that the upper end of said primary strap may be releasably buckled to said keeper, the pouch being of sufficient size to stow said primary strap inside with the support secured to the lower end of said primary strap hanging from said opening in a position fixed by the closure of said flap.

2. The device of claim 1, wherein said support comprises a tubular member on which said gripping surface is disposed and wherein said support strap extends through the hollow interior of said tubular member with the ends of said support strap attached to said complimentary component of the second releasable buckle.

3. The device of claim 2, wherein said support floats.

4. The device of claim 1, further comprising written instructions disposed on said device.

5. The device of claim 1, further comprising at least one secondary strap adjustable in length, wherein said secondary strap comprises an upper and a lower end, and at least one component of a third releasable buckle, the upper end of said secondary strap secured to said primary strap, and the lower end defined by said component; and a secondary support, said secondary support comprising a gripping surface secured by a secondary support strap to the complementary component of the third releasable buckle, such that the lower end of said secondary strap may be releasably buckled to said secondary support.

6. The device of claim 5, further comprising a plurality of said secondary steps and said secondary supports.

7. The device of claim 5, further comprising a tertiary strap, adjustable in length, wherein said tertiary strap comprises an upper and a lower end, and at least one component of a fourth releasable buckle, the upper end of said tertiary strap secured to said secondary strap, and the lower end defined by said component; and a tertiary support, said tertiary support comprising a gripping surface secured by a tertiary support strap to the complementary component of the fourth releasable buckle, such that the lower end of said tertiary strap may be releasably buckled to said tertiary support.

8. The device of claim 7, wherein the tertiary strap is adjusted to be longer than the secondary strap, and the secondary strap is adjusted to be longer than the primary strap, such that in combination the tertiary, secondary, and primary supports form a ladder.

9. The device of claim 1, further comprising at least one secondary strap adjustable in length, wherein said secondary strap comprises an upper and a lower end, the upper end of said secondary strap secured to said primary strap, and the lower end terminating in an attachment member.

10. The device of claim 9, where in said attachment member is selected from the group consisting of a closed loop, a clasp, a ring, and one component of a two-component releasable buckle.

11. A safety device comprising:

a support;

a strap with an upper and a lower end, the lower end attached to the support; and a keeper comprising an inner and an outer layer of approximately the same dimensions, the outer layer substantially aligned with and overlaying the inner layer, each said layer having upper, lower, and first and second side perimeters, said layers affixed to one another along their lower and first side perimeters, with interlocking fasteners disposed along facing surfaces of the upper and second perimeters of each said layer, the fasteners of the inner layer adapted to interlock with those of the outer layer, the inner layer having a slot therethrough, the upper end of said strap extending through said slot for attachment to a vessel, person or other object;

such that the inner and outer layers of said keeper may be interlocked together forming an enclosure in which the strap may be gathered with said support hanging from the junction of the upper perimeters of said layers, whereby said support when pulled will cause said strap to extend from said enclosure.

12. The device of claim 11 wherein said support floats.

13. The device of claim 11, wherein the upper end of said strap terminates in a member selected from the group consisting of a closed loop, a clasp, a ring, and one component of a two-component releasable buckle.

14. The device of claim 11, wherein said strap further comprises at least one releasable buckle, each said buckle comprising two components complementary to one another to interlock releasably together.

15. The device of claim 11, further comprising written instructions disposed on said device.

16. A safety device comprising:

a support;

a strap with an upper and a lower end, the lower end attached to the support; and a keeper comprising an inner and an outer layer of approximately the same dimensions, the outer layer substantially aligned with and overlaying the inner layer, each said layer having upper, lower, and first and second side perimeters, said layers affixed to one another along their lower and first side perimeters, with interlocking fasteners disposed along facing surfaces of the upper and second perimeters of each said layer, the fasteners of the inner layer adapted to interlock with those of the outer layer, the upper end of said strap secured to said inner layer, the back side of said inner layer comprising means for attachment of said keeper to a vessel, person or other object;

such that the inner and outer layers of said keeper may be interlocked together forming an enclosure in which the strap may be gathered with said support hanging from the junction of the upper perimeters of said layers, whereby said support when pulled will cause said strap to extend from said enclosure.

17. The device of claim 16 wherein said support floats.

18. The device of claim 16, wherein said strap further comprises at least one releasable buckle, each said buckle comprising two components complementary to one another to interlock releasably together.

19. The device of claim 16, further comprising written instructions disposed on said device.

* * * * *